US008870240B2

(12) United States Patent
Lee et al.

(10) Patent No.: US 8,870,240 B2
(45) Date of Patent: Oct. 28, 2014

(54) DOOR LATCH APPARATUS FOR VEHICLE

(75) Inventors: Sang Hyun Lee, Jeju-si (KR); Ki Ryun Ahn, Daegu (KR); Rae Ung Jeong, Daegu (KR)

(73) Assignees: Hyundai Motor Company, Seoul (KR); Pyeong Hwa Automotive Co., Ltd., Daegu (KR)

( * ) Notice: Subject to any disclaimer, the term of this patent is extended or adjusted under 35 U.S.C. 154(b) by 164 days.

(21) Appl. No.: 13/532,493

(22) Filed: Jun. 25, 2012

(65) Prior Publication Data

US 2013/0147209 A1 Jun. 13, 2013

(30) Foreign Application Priority Data

Dec. 12, 2011 (KR) ..... 10-2011-0133138

(51) Int. Cl.
*E05C 5/02* (2006.01)

(52) U.S. Cl.
USPC ..... 292/57

(58) Field of Classification Search
CPC ..... E05B 85/16; E05B 77/06
USPC ..... 292/1, 201, 216, 336.3, DIG. 23, 292/DIG. 22, DIG. 65, 57, 196, 200
See application file for complete search history.

(56) References Cited

U.S. PATENT DOCUMENTS

| | | | | |
|---|---|---|---|---|
| 3,799,596 | A * | 3/1974 | Nozomu et al. | 292/216 |
| 4,536,021 | A * | 8/1985 | Mochida | 292/201 |
| 5,865,481 | A * | 2/1999 | Buschmann | 292/216 |
| 2003/0234544 | A1* | 12/2003 | Jankowski et al. | 292/220 |
| 2010/0283268 | A1* | 11/2010 | Cumbo | 292/196 |

* cited by examiner

*Primary Examiner* — Kristina Fulton
*Assistant Examiner* — Nathan Cumar
(74) *Attorney, Agent, or Firm* — Morgan, Lewis & Bockius LLP

(57) ABSTRACT

A door latch apparatus for a vehicle may include a release lever rotatably coupled on a base plate by a hinge pin, the release lever being provided with a locking part, an open lever provided on the hinge pin to be rotatable along with the release lever, the open lever locking or unlocking a door of the vehicle, a rotating lever rotatably coupled on the base plate by a rotating shaft, the rotating lever being connected to a door handle by a wire so that the rotating lever is rotated by operation of the wire, and an operating lever rotatably mounted on the hinge pin, the operating lever being provided with a locking protrusion, wherein the locking protrusion is disposed between the locking part of the release lever and the rotating lever when an external impact is not applied or applied less than a predetermined amount to the operating lever.

8 Claims, 7 Drawing Sheets

DOOR LATCH APPARATUS FOR VEHICLE

CROSS-REFERENCE TO RELATED APPLICATIONS

The present application claims priority to Korean Patent Application No. 10-2011-0133138 filed on Dec. 12, 2011, the entire contents of which is incorporated herein for all purposes by this reference.

BACKGROUND OF THE INVENTION

1. Field of the Invention

The present invention relates to a door latch apparatus for a vehicle which is configured such that a door is prevented from opening while a side collision is occurring, and the door is allowed to open after the side collision is over.

2. Description of Related Art

FIG. 1 is a view showing a conventional door latch apparatus for a vehicle. FIG. 2 is a view showing the operation of the door latch apparatus of FIG. 1. FIG. 3 is a side view of the door latch apparatus of FIG. 1.

As shown in the drawings, the conventional door latch apparatus includes a release lever 20 which is rotatably provided on a base plate 10. On the release lever there is provided a locking part 24 that extends a predetermined length downwards, and a rotating lever 30 is rotatably installed on the base plate 10 at a position adjacent to the locking part 24. A wire is connected to a lower end 31 of the rotating lever 30 so that when a passenger operates a door handle, the wire is pulled, rotating the rotating lever 30 in the clockwise direction.

Furthermore, a locking protrusion 32 is provided on an upper end of the rotating lever 30. Thus, when the wire is pulled, the rotating lever 30 rotates around a rotating shaft 33 in the clockwise direction, and the locking protrusion 32 pushes the locking part 24 of the release lever 20 in the counterclockwise direction. Thereby, the release lever 20 rotates in the counterclockwise direction, thus also rotating an open lever 40 in the counterclockwise direction. Eventually, the open lever 40 that rotates in the counterclockwise direction unlocks the lock of the door.

The release lever 20 is provided with a restoring spring 22 so that when the pulling force which has been transmitted to the release lever 20 from the door handle through the wire is removed, the release lever 20 can return to its original position.

FIG. 1 illustrates the locked state of the conventional door latch apparatus. FIG. 2 illustrates the unlocked state of the door latch apparatus. FIG. 3 is a side view of the door latch apparatus, from which the base plate has been skipped for the sake of understanding.

In this conventional door latch apparatus having the above-mentioned construction, when the vehicle is involved in a side collision, for example, when impact is applied to the door from the left based on FIGS. 1 and 2, if a passenger manipulates the door handle, the wire is directly pulled, thus unexpectedly opening the door.

In other words, the conventional door latch apparatus allows latching and releasing of the door even when a side collision is occurring. This means that there is a probability that the door will open while the collision is occurring, deteriorating safety.

To take safety into account, in the side collision, the door must not open when the collision is ongoing, but after the collision is over, the door must be able to open to allow a passenger to escape from the vehicle. A door latch apparatus which incorporates such safety in a collision is required.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a door latch apparatus for a vehicle which is configured such that a door is prevented from opening when a side collision is occurring, and the door is allowed to open after the side collision is over.

In an aspect of the present invention, a door latch apparatus for a vehicle, may include a release lever rotatably coupled on a base plate by a hinge pin, the release lever being provided with a locking part extending downwards, an open lever provided on the hinge pin so as to be rotatable along with the release lever, the open lever locking or unlocking a door of the vehicle, a rotating lever rotatably coupled on the base plate by a rotating shaft below the release lever, the rotating lever being connected to a door handle by a wire so that the rotating lever is rotated by operation of the wire, and an operating lever rotatably mounted on the hinge pin, the operating lever being provided with a locking protrusion, wherein the locking protrusion is disposed between the locking part of the release lever and the rotating lever when an external impact is not applied or applied less than a predetermined amount to the operating lever so that when the rotating lever rotates and pushes the locking protrusion, the locking protrusion pushes and rotates the locking part, thus unlocking the door, and wherein when the external impact is applied to the operating lever beyond the predetermined amount in a side collision of the vehicle, the operating lever is reversely rotated by inertia and the locking protrusion is removed from between the locking part and the rotating lever.

The release lever is elastically provided on the hinge pin of the base plate by a spring so that the release lever returns to an original position thereof after the release lever having rotated.

The rotating lever may have a first end connected to the wire and a second end coming into contact with the locking protrusion when the external impact is not applied or applied less than the predetermined amount to the operating lever.

The rotating lever may have a first end connected to the wire, a second end coming into contact with the locking protrusion when the external impact is not applied or applied less than the predetermined amount to the operating lever, and a medial portion rotatably coupled to the base plate by the rotating shaft.

The second end of the rotating lever is inclined towards an outside of the vehicle so that when the operating lever is reversely rotated by the inertia, the second end of the rotating lever is prevented from restricting the removal of the locking protrusion.

The operating lever is rotatably mounted at an upper end thereof to the base plate by the hinge pin and extends a predetermined length downwards.

The locking protrusion is provided on a medial portion of the operating lever, and a weight is provided on a lower end of the operating lever.

A medial portion of the operating lever protrudes toward an outside of the vehicle from an upper end and a lower end thereof, wherein the upper end is mounted to the base plate by the hinge pin, the locking protrusion is provided on the medial portion, and a weight is provided on the lower end thereof.

A door latch apparatus for a vehicle according to the present invention makes use of a weight structure such that in a side collision of the vehicle, even when a door handle is operated by a passenger or other objects in the compartment of the vehicle, the door cannot open while the collision is occurring. On the other hand, after the collision is over, it again becomes possible for the passenger to open the door using the door handle.

Therefore, while the collision is ongoing, the door is prevented from opening, and after the collision is over, the door is allowed to open. As a result, safety in the collision can be ensured.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
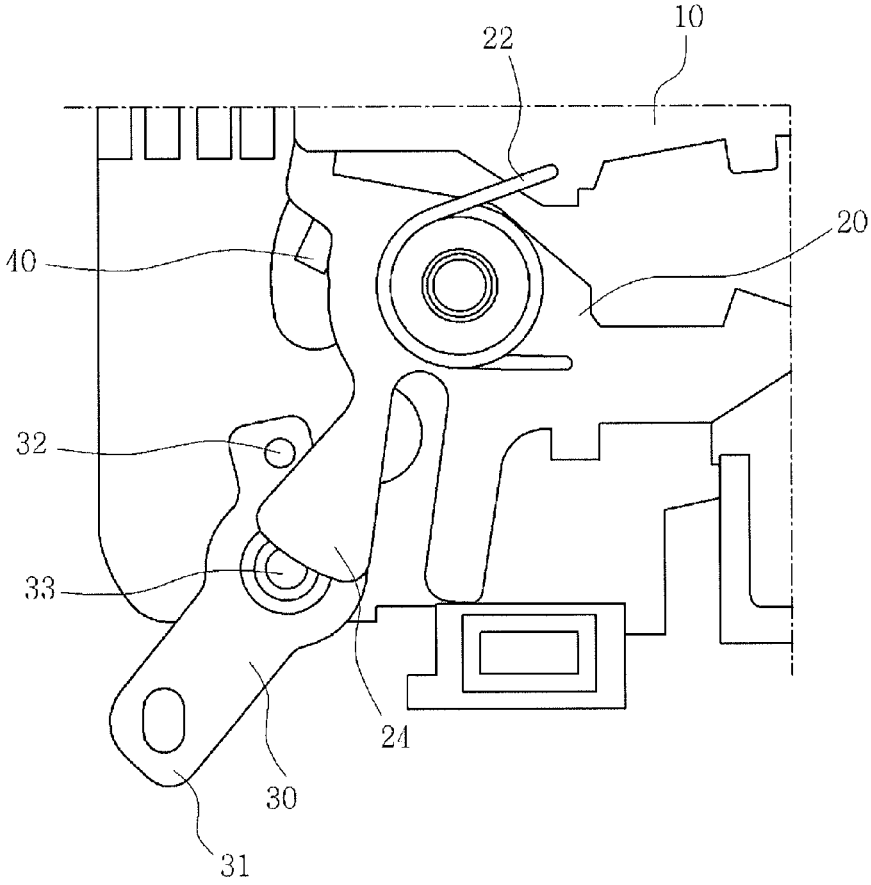
FIG. 1 (Related Art)
FIG. 1 is a view showing a conventional door latch apparatus for a vehicle.
Figure 2:
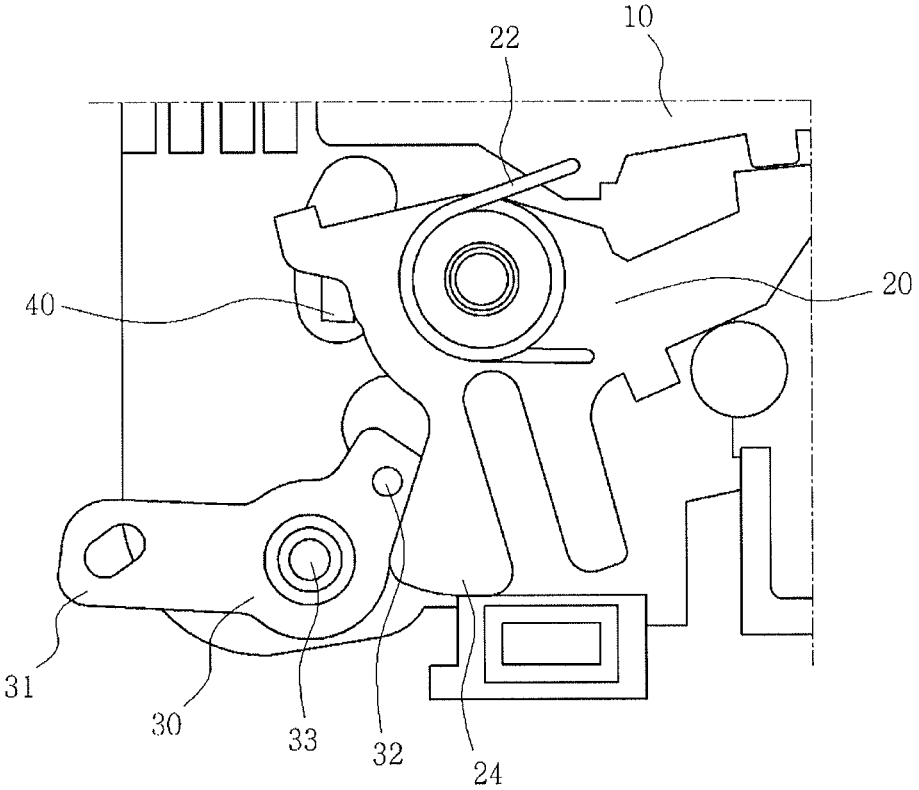
FIG. 2 (Related Art)
FIG. 2 is a view showing the operation of the door latch apparatus of FIG. 1.
Figure 3:
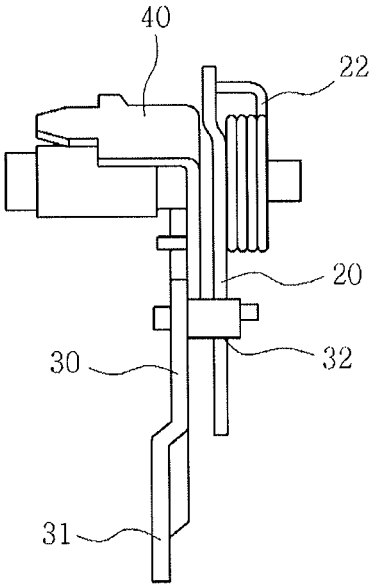
FIG. 3 (Related Art)
FIG. 3 is a side view of the door latch apparatus of FIG. 1.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinafter, a door latch apparatus for a vehicle according to an embodiment of the present invention will be described in detail with reference to the attached drawings.

Figure 4:
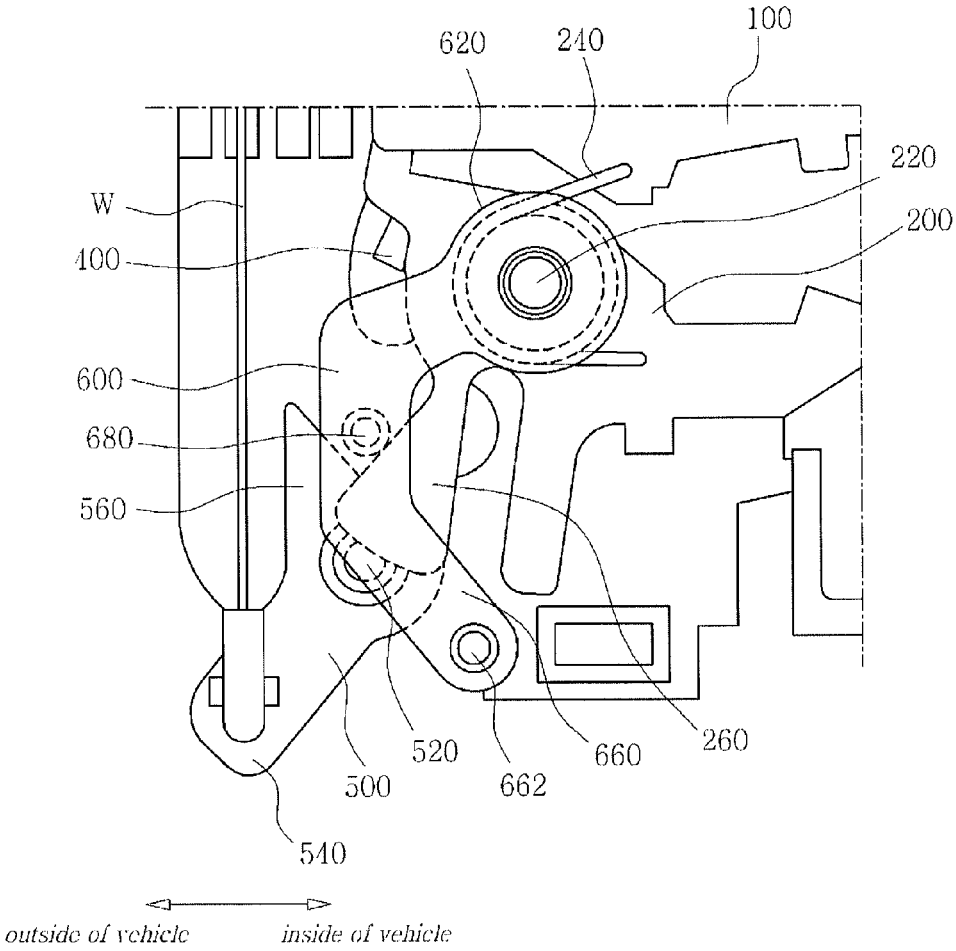
FIG. 4 is a view showing the construction of a door latch apparatus for a vehicle according to an exemplary embodiment of the present invention.
Figure 5:
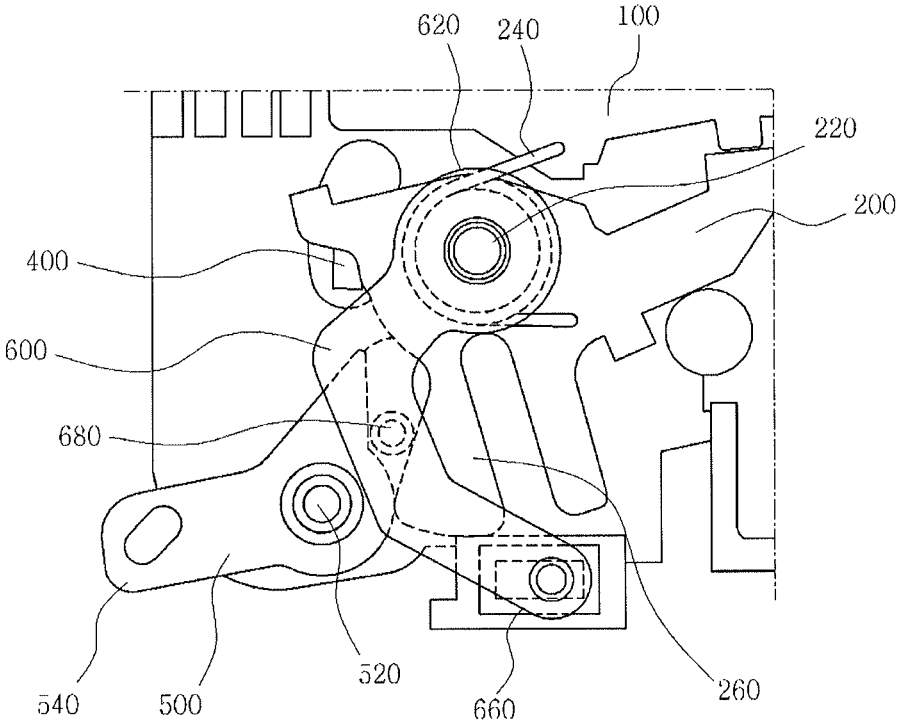
FIG. 5 is a view illustrating an unlocking operation of the door latch apparatus according to the exemplary embodiment of the present invention.
Figure 6:
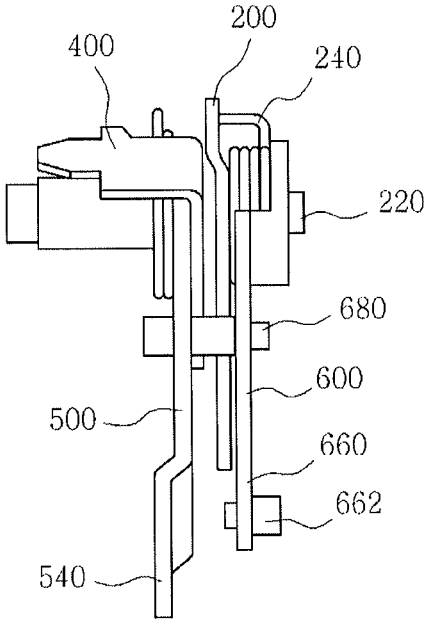
FIG. 6 is a side view of the door latch apparatus according to the exemplary embodiment of the present invention.

FIG. 4 is a view showing the construction of the door latch apparatus according to the exemplary embodiment of the present invention. FIG. 5 is a view illustrating an unlocking operation of the door latch apparatus according to the exemplary embodiment of the present invention. FIG. 6 is a side view of the door latch apparatus according to the exemplary embodiment of the present invention.

The door latch apparatus according to an exemplary embodiment of the present invention includes a release lever 200, an open lever 400, a rotating lever 500 and an operating lever 600. The release lever 200 is mounted to a base plate 100 by a hinge pin 220 and is provided with a locking part 260 that extends downwards. The open lever 400 is provided around the hinge pin 220 so as to be rotatable along with the release lever 200 and locks or unlocks a vehicle door. The rotating lever 500 is provided on the base plate 100 by a rotating shaft 520 below the release lever 200. An end of the rotating lever 500 is connected to a door handle by a wire W so that the rotating lever 500 is rotated by the operation of the wire W. The operating lever 600 is rotatably mounted at a first end thereof to the base plate 100. The operating lever 600 is provided with a locking protrusion 680 that is disposed between the locking part 260 of the release lever 200 and the rotating lever 500. When the rotating lever 500 rotates, the locking protrusion 680 pushes and rotates the locking part 260 so that the door is unlocked. When the vehicle is involved in a side collision, the operating lever 600 is reversely rotated by the inertia so that the locking protrusion 680 is removed from between the locking part 260 and the rotating lever 500.

The door latch apparatus includes components that are provided on the base plate 100. When a passenger in the passenger compartment of the vehicle pulls the door handle, the wire W connected to the door handle is pulled. Pulling the wire W rotates the rotating lever 500 in the clockwise direction in the drawings.

The rotation of the rotating lever 500 makes an upper end 560 of the rotating lever 500 push the locking protrusion 680. Then, the locking protrusion 680 pushes the locking part 260 that extends downwards from the release lever 200. Thus, the locking part 260 is rotated in the counterclockwise direction.

Thereby, as shown in FIG. 5, the release lever 200 rotates in the counterclockwise direction. The open lever 400 that is interlocked to the release lever 200 also rotates in the counterclockwise direction, thus unlocking a locking device of the door.

After the door has been unlocked, the wire W returns to its original position so that the release lever 200 is released from the locking protrusion 680 which has pushed the release lever 200. Thus, the release lever 200 is returned to its original position by the restoring force of a spring 240.

That is, in the door latch apparatus of the present invention, the operating force for unlocking the door is transmitted in the sequence of: door handle—wire W—rotating lever 500—locking protrusion 680—release lever 200—open lever 400.

The release lever 200 is provided with the spring 240 on the hinge pin 220 of the base plate 100 so that the release lever 200 which has rotated can return to its original position.

The rotating lever 500 is configured such that a first end 540 thereof is connected to the wire W and the second end 560 thereof comes into contact with the locking protrusion 680. In detail, the lower end (first end) 540 of the rotating lever 500 is connected to the wire W, and the upper end (second end) 560 thereof comes into contact with the locking protrusion 680. A medial portion of the rotating lever 500 is mounted to the base plate 100 by the rotating shaft 520. Thus, when pulling the wire W, the rotating lever 500 rotates and reliably pushes the locking protrusion 680.

Furthermore, the upper end 560 of the rotating lever 500 is slanted towards the outside of the vehicle so that when the operating lever 600 is reversely rotated by inertia, the upper end 560 is prevented from restricting the removal of the locking protrusion 680, and when the intensity of a side collision is enough for the inertia to act, the locking protrusion 680 is completely removed from its normal position, thus ensuring safety.

The operating lever 600 is coupled at an upper end 620 thereof to the base plate 100 by the hinge pin 220 and extends a predetermined length downwards. The locking protrusion 680 is provided on a medial portion of the operating lever 600. A weight 662 is provided on a lower end 660 of the operating lever 600.

In detail, the upper end 620 and the lower end 660 of the operating lever 600 are bent towards the inside of the vehicle based on the medial portion thereof. The upper end 620 is mounted to the base plate 100 by the hinge pin 220. The locking protrusion 680 is provided on the medial portion of the operating lever 600. The weight 662 is provided on the lower end 660. Thus, the operating lever 600 is configured such that the lower end 660 is biased towards the ground by the weight 662, and the locking protrusion 680 is availably disposed between the locking part 260 and the rotating lever 500.

Due to this structure, as soon as a side collision is over, the weight 662 makes use of the gravitational force and rapidly returns the locking protrusion 680 to its original position. In other words, the structure of the operating lever 600 in which the upper end 620 and the lower end 660 are bent inwards and the medial portion thereof is disposed at a comparatively outer position can rapidly make the operating lever 600 to move using the inertia and return it to its original position using gravity.

Figure 7:
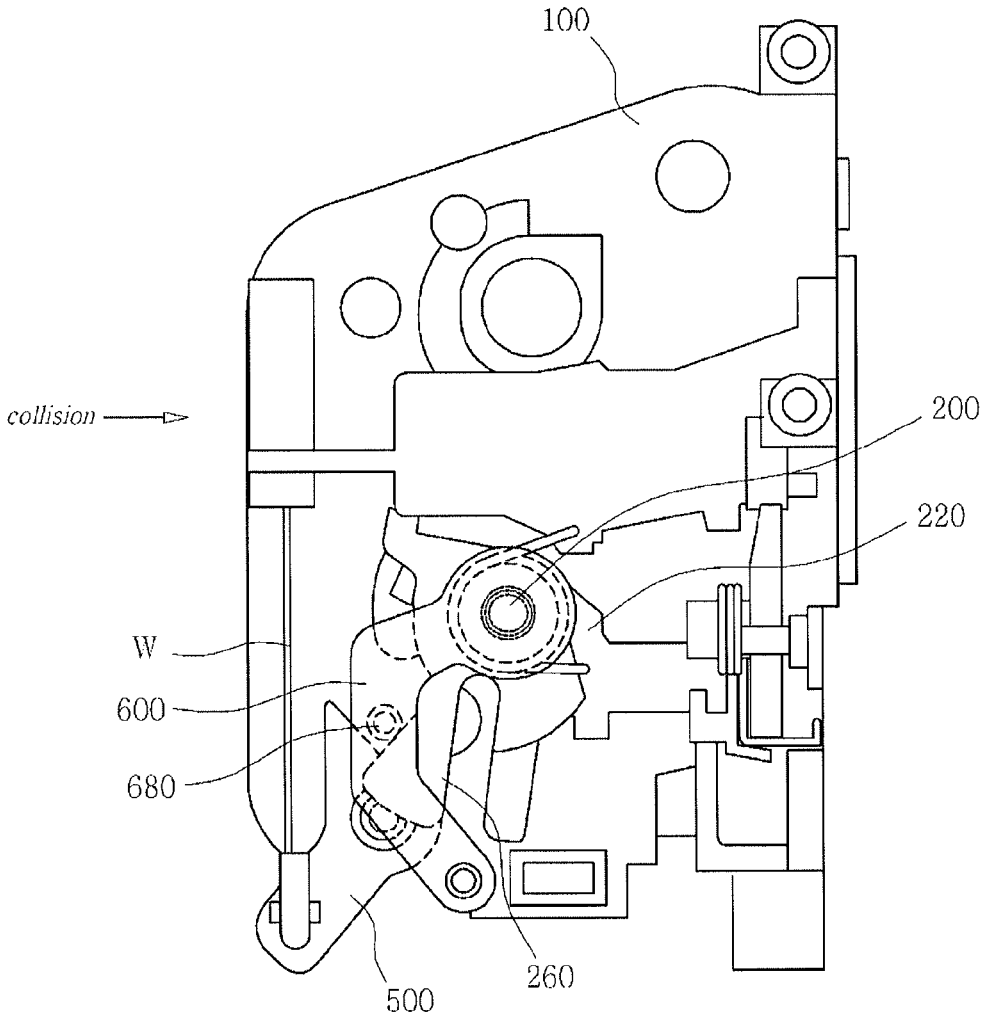
FIGS. 7 through 9 are views illustrating the operation of the door latch apparatus in chronological order when the vehicle is involved in a side collision, according to the exemplary embodiment of the present invention.
Figure 8:
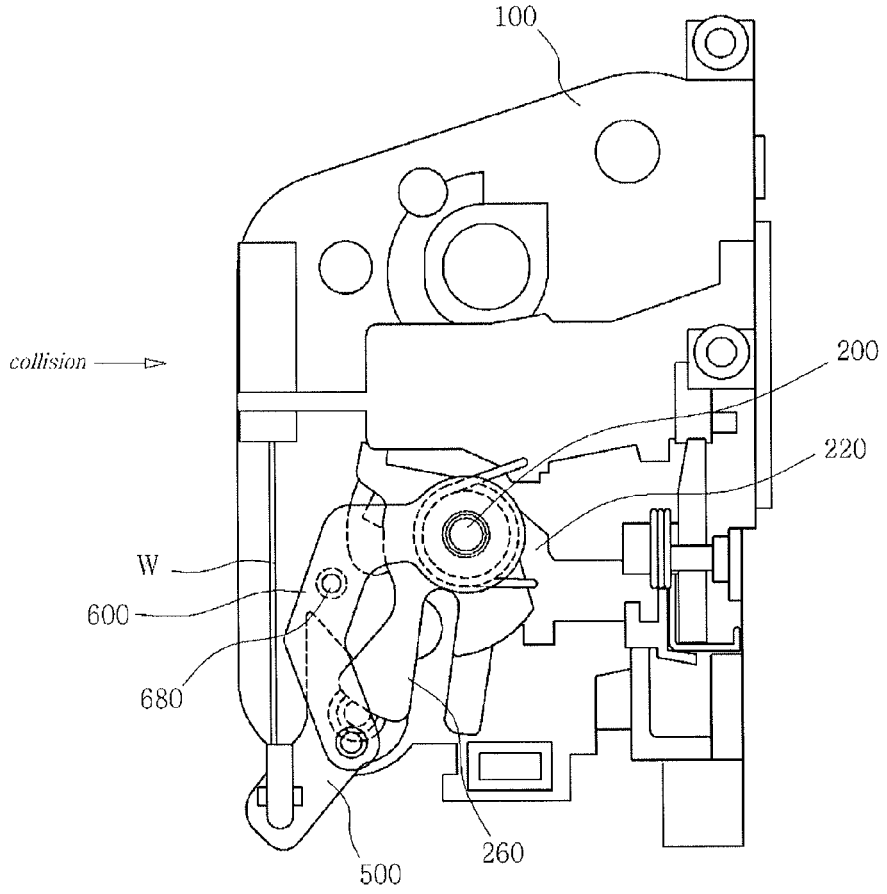
Figure 9:
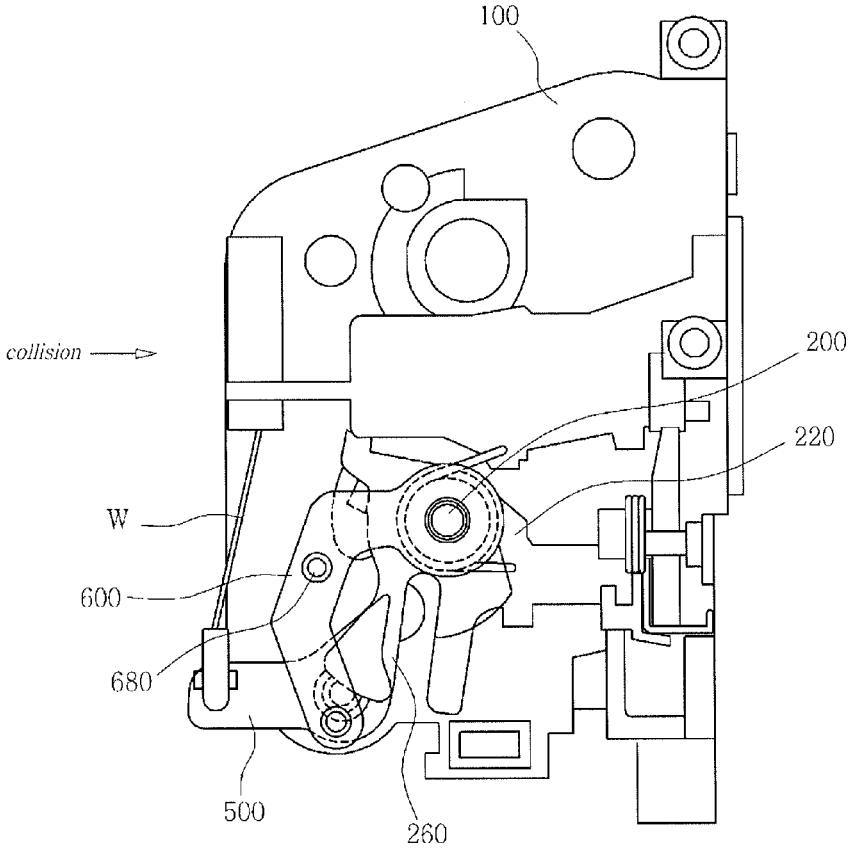

FIGS. 7 through 9 are views illustrating the operation of the door latch apparatus in chronological order when the vehicle is involved in a side collision, according to the exemplary embodiment of the present invention. The operation of the door latch apparatus in a collision will be described with reference to these drawings.

At an initial stage of the side collision, as shown in FIG. 7, the door latch apparatus of the present invention is in the normal state. Subsequently, when the collision is ongoing and inertia is applied to the vehicle in the direction opposite to the direction of the collision, force is applied to the operating lever 600 provided with the weight 662 towards the outside of the vehicle because of the inertia. This force rotates the operating lever 600 around the hinge pin 220 in the clockwise direction, as shown in FIG. 8.

Thereby, the locking protrusion 680 of the operating lever 600 is removed from between the locking part 260 and the rotating lever 500. Therefore, during this time for which the collision is ongoing, even if the door handle is operated by a passenger or other objects or the wire W is pulled, the rotating lever 500 cannot push the release lever 200 (refer to FIG. 9), because there is no locking protrusion 680 between the locking part 260 and the rotating lever 500. Eventually, the release lever 200 and the open lever 400 keep their own positions so that the door can stay in the locked state. Because the restoring force of the spring 240 is applied to the release lever 200, even when the inertia is applied thereto, the release lever 200 is prevented from rotating, thus ensuring safety.

Subsequently, after the collision has been completed, the inertia is removed from the operating lever 600 so that the gravitational force returns the operating lever 600 to its original position. Thus, as shown in FIG. 7, the locking protrusion 680 is disposed between the locking part 260 and the rotating lever 500 again, thus enabling the passenger to unlock the door.

As described above, a door latch apparatus for a vehicle according to an exemplary embodiment of the present invention makes use of a weight structure such that in a side collision of the vehicle, even when the door handle is operated by a passenger or other objects in the compartment of the vehicle, the door cannot open while the collision is ongoing. On the other hand, after the collision is over, it again becomes possible for the door handle to be used by a passenger to open the door.

Therefore, while the collision is ongoing, the door is prevented from opening, and after the collision is over, the door is allowed to open. As a result, safety in the collision can be ensured.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A door latch apparatus for a vehicle, comprising:

a locking device;

a release lever rotatably coupled on a base plate by a hinge pin and selectively locking the locking device, the release lever being provided with a locking part extending downwards;

an open lever provided on the hinge pin so as to be rotatable along with the release lever;

a rotating lever rotatably coupled on the base plate by a rotating shaft below the release lever, the rotating lever being connected to a door handle by a wire so that the rotating lever is rotated by operation of the wire; and an operating lever rotatably mounted on the hinge pin, the operating lever being provided with a locking protrusion;

wherein the locking protrusion is disposed between the locking part of the release lever and the rotating lever when an external impact is not applied or applied less than a predetermined amount to the operating lever so that when the rotating lever rotates and pushes the locking protrusion, the locking protrusion pushes and rotates the locking part of the release lever to release the locking device, thus unlocking the door; and wherein when the external impact is applied to the operating lever beyond the predetermined amount in a side collision of the vehicle, the operating lever is reversely rotated by inertia and the locking protrusion is removed from between the locking part and the rotating lever.

2. The door latch apparatus as set forth in claim 1, wherein the release lever is elastically provided on the hinge pin of the base plate by a spring so that the release lever returns to an original position thereof after the release lever having rotated.

3. The door latch apparatus as set forth in claim 1, wherein the rotating lever has a first end connected to the wire and a second end coming into contact with the locking protrusion when the external impact is not applied or applied less than the predetermined amount to the operating lever.

4. The door latch apparatus as set forth in claim 1, wherein the rotating lever has a first end connected to the wire, a second end coming into contact with the locking protrusion when the external impact is not applied or applied less than the predetermined amount to the operating lever, and a medial portion rotatably coupled to the base plate by the rotating shaft.

5. The door latch apparatus as set forth in claim 4, wherein the second end of the rotating lever is inclined towards an outside of the vehicle so that when the operating lever is reversely rotated by the inertia, the second end of the rotating lever is prevented from restricting the removal of the locking protrusion.

6. The door latch apparatus as set forth in claim 1, wherein the operating lever is rotatably mounted at an upper end thereof to the base plate by the hinge pin and extends a predetermined length downwards.

7. The door latch apparatus as set forth in claim 6, wherein the locking protrusion is provided on a medial portion of the operating lever, and a weight is provided on a lower end of the operating lever.

8. The door latch apparatus as set forth in claim 1, wherein a medial portion of the operating lever protrudes toward an outside of the vehicle from an upper end and a lower end thereof, and wherein the upper end is mounted to the base plate by the hinge pin, the locking protrusion is provided on the medial portion, and a weight is provided on the lower end thereof.

* * * * *